US010240740B2

(12) United States Patent
Seiger et al.

(10) Patent No.: US 10,240,740 B2
(45) Date of Patent: Mar. 26, 2019

(54) LIGHT MODULE FOR A LIGHTING APPARATUS OF A VEHICLE

(71) Applicant: Hella KGaA Hueck & Co., Lippstadt (DE)

(72) Inventors: Ralf Seiger, Lippstadt (DE); Heinz-Uwe Spork, Lippstadt (DE)

(73) Assignee: Hella KGaA Hueck & Co., Lippstadt (DE)

( * ) Notice: Subject to any disclaimer, the term of this patent is extended or adjusted under 35 U.S.C. 154(b) by 0 days.

(21) Appl. No.: 15/662,883

(22) Filed: Jul. 28, 2017

(65) Prior Publication Data

US 2018/0031194 A1 Feb. 1, 2018

(30) Foreign Application Priority Data

Jul. 28, 2016 (DE) ..... 10 2016 113 937

(51) Int. Cl.

| | |
|---|---|
| ***F21S 41/19*** | (2018.01) |
| ***F21V 7/00*** | (2006.01) |
| ***F21V 19/00*** | (2006.01) |
| ***F21S 41/39*** | (2018.01) |
| ***F21S 41/33*** | (2018.01) |
| ***F21S 45/49*** | (2018.01) |
| ***F21S 45/47*** | (2018.01) |
| ***F21S 41/148*** | (2018.01) |

(52) U.S. Cl.

CPC ..... *F21S 41/192* (2018.01); *F21S 41/148* (2018.01); *F21S 41/19* (2018.01); *F21S 41/196* (2018.01); *F21S 41/336* (2018.01); *F21S 41/39* (2018.01); *F21S 45/47* (2018.01); *F21S 45/49* (2018.01); *F21V 7/0066* (2013.01); *F21V 19/002* (2013.01)

(58) Field of Classification Search

USPC ..... 362/459–549

See application file for complete search history.

(56) References Cited

U.S. PATENT DOCUMENTS

| | | | | |
|---|---|---|---|---|
| 2015/0252973 | A1* | 9/2015 | Muller | F21S 48/1109 362/516 |
| 2015/0266407 | A1 | 9/2015 | Rubia Mena et al. | |
| 2016/0131324 | A1 | 5/2016 | Windgruber | |

FOREIGN PATENT DOCUMENTS

| | | | |
|---|---|---|---|
| AT | 516303 | A1 | 4/2016 |
| DE | 202 08 295 | U1 | 8/2002 |
| DE | 10 2012 106005 | A1 | 1/2014 |
| WO | WO 2014 1190368 | A1 | 12/2014 |

* cited by examiner

*Primary Examiner* — Matthew Mikels

(74) *Attorney, Agent, or Firm* — Muncy, Geissler, Olds & Lowe, P.C.

(57) ABSTRACT

A light module for a lighting apparatus of a vehicle having a reflector body, a light generating unit having at least one light source, a carrier on which the light generating unit is arranged. The light generating unit is replaceably arranged on the light module. The reflector body has at least one reference surface and the light generating unit has at least one locating surface. The locating surface can be brought to rest against the reference surface during insertion of the light generating unit into the light module in order to create a precisely positioned arrangement of the light generating unit on the reflector body.

9 Claims, 2 Drawing Sheets

LIGHT MODULE FOR A LIGHTING APPARATUS OF A VEHICLE

This nonprovisional application claims priority under 35 U.S.C. § 119(a) to German Patent Application No. 10 2016 113 937.8, which was filed in Germany on Jul. 28, 2016, and which is herein incorporated by reference.

BACKGROUND OF THE INVENTION

Field of the Invention

The invention relates to a light module for a lighting apparatus of a vehicle having a reflector body, further including a light generating unit having at least one light source, wherein a carrier is provided on which the light generating unit is arranged, and wherein the light generating unit is replaceably arranged on the light module.

Description of the Background Art

US 2015/0266407 A1 discloses a light module for a lighting apparatus of a vehicle having a reflector body, and a light generating unit is arranged on a carrier, wherein the carrier can be arranged in a precise position aligned on the reflector body. The light source arranged on the light generating unit radiates into the reflector, wherein a precise position of the light source relative to the reflector body can be maintained only with increased effort. For example, it is necessary to align the light generating unit relative to the carrier, and lastly the carrier must be aligned precisely on the reflector body so that the light source assumes the required position relative to the reflector body.

The light modules can be installed in headlights, or themselves constitute the headlight if the light module includes an appropriate housing. For service or replacement of a light source, a light generating unit equipped with semiconductor light sources must also be replaceably arranged on the light module, wherein easy replacement of the light generating unit should be made possible. The top priority here is the reproducible, precise arrangement of the light source relative to the reflector body, wherein it is especially advantageous and makes for better manageability if the light generating unit is removable from the light module together with the carrier. For example, if a user has removed the light generating unit together with the carrier from the light module, the light generating unit can be removed from the carrier far away from the light module, and a new light generating unit can be arranged on the carrier again. Finally, the carrier with the replaced light generating unit can be reinstalled on the light module. In this process, it should be possible to arrange the carrier with the light generating unit on the reflector body such that a precise arrangement of the light source relative to the reflector body with no error influences is ensured.

Clasps, springs, clamps, or the like, such as are shown in US 2015/0338049 A1, for example, serve to fasten the carrier with the light generating unit to the reflector body. In this design, too, the light generating unit is precisely aligned on a carrier, and the carrier in turn is arranged in a precise location on the reflector body through a positioner. As a result of the increased error influence with a chain of positionings between the light generating unit and the carrier on the one hand, and between the carrier and the reflector body on the other hand, a reproducible, precise location of the light source relative to the reflector body is not inherently ensured.

SUMMARY OF THE INVENTION

It is therefore an object of the invention to improve a light module for a lighting apparatus of a vehicle, wherein the light module should be simple in design and wherein a precisely/predetermined positioned arrangement of the light source relative to the reflector body should be ensured when the light generating unit is replaced.

The invention includes the technical teaching that the reflector body has at least one reference surface, and that the light generating unit has at least one locating surface, so that the locating surface can be brought to rest against the reference surface during insertion of the light generating unit in the light module in order to create a precisely positioned arrangement of the light generating unit on the reflector body.

The essence of the invention is a minimal number of components through which the light source is positioned relative to the reflector body. The minimal number is achieved by the means that at least one locating surface on the light generating unit can be brought directly into contact with a reference surface that is located directly on the reflector body. Consequently the carrier no longer plays any role for positioning of the light generating unit, and thus of the light source, relative to the reflector body.

The purpose or only purpose that the carrier now serves is to accommodate the light generating unit so that the light generating unit can be arranged on the reflector body by means of the carrier and aligned via the surfaces. The locating surface and the reference surface are each designed such that the light generating unit together with the carrier can be removed from the light module and replaced in it as many times as desired without the possibility of errors occurring in the precise orientation of the light source relative to the reflector body. As a result, errors in positioning the light source relative to the reflector body are avoided, especially for uninformed users.

The light module according to an embodiment of the invention has at least one light source, which is designed as a semiconductor light source, and which is arranged on or at the light generating unit. For example, a light-emitting diode or a laser diode constitutes the semiconductor light source. Consequently, the light module according to the invention permits the light source to be replaced in the ordinary way, as has hitherto also been possible for incandescent light bulbs or gas discharge lamps. In a sense, the locating surface forms a socket relative to the reference surface so that the light source can be positioned in the socket like a conventional lamp, and a retaining arrangement of the light generating unit together with the carrier is only possible when the light generating unit, and thus the light source, is arranged on the reflector body in the correct position.

An improved implementation of the light module is achieved when a first reference surface and a second reference surface are formed on the reflector body, wherein locating surfaces on the light generating unit are associated with each of the reference surfaces. A statically determinate state of contact of the light generating unit on the reflector body is created by means of at least two partially independent reference surfaces and associated locating surfaces. Furthermore, it is also possible to provide more than two reference surfaces and more than two associated locating surfaces.

The reference surfaces and the complementary locating surfaces, in further advantageous fashion, can be elongated in extent, and the reference surfaces can be spaced laterally apart with respect to the elongated extent and can be designed to be essentially parallel to one another. Consequently, the two reference surfaces can form rails that can accommodate the locating surfaces like skids when the locating surfaces are placed on the reference surfaces. The at least one light source can be arranged on the light generating unit between the two reference surfaces and consequently between the two locating surfaces.

The reflector body can have a receiving opening, wherein the reference surfaces and/or the stop can at least partially border the receiving opening and/or can be arranged adjacent to the receiving opening. In this design, the reflector body can have a reflector surface at least in part, and the light generating unit with the carrier is accommodated on a region of the reflector body that does not correspond to the reflector surface, for example. For instance, the receiving region on the reflector body can project beyond the reflector surface such that the receiving opening faces toward the reflector surface. When the light generating unit is arranged on the reflector body, the light source reaches its position within the receiving opening, and can radiate into the reflector surface of the reflector body.

In an embodiment, the carrier can at least partially constitute a heat sink and/or that the light generating unit is retentively arranged on the carrier so that the light generating unit with the carrier can be removed from the light module as a structural unit. As a result, it is possible to do the following outside the light module: disconnect the light generating unit from the carrier and, e.g., replace it with a new light generating unit and reattach it to the carrier. The structural unit can be arranged on the light module again in another step.

It is also advantageous if at least one stop is formed on the reflector body, against which stop a counterstop formed on the light generating unit can be brought to rest, by which means the light generating unit can be aligned in a planar fashion on the reflector body in a plane spanned by the at least one locating surface.

Furthermore, the carrier covers the light generating unit when the carrier with the light generating unit is located on the reflector body, and wherein the light generating unit at least largely closes the receiving opening in the reflector body. In this way, the light generating unit arranged on the reflector body is protected by the carrier, and the possibility exists that only the region of the at least one light source on the light generating unit projects into the receiving opening of the reflector body.

A retaining clip can be provided with which the carrier can be braced on the reflector body such that at least the locating surface of the light generating unit comes to rest against the reference surface of the reflector body. The retaining clip can extend around the carrier in such a way that bracing the retaining clip causes the carrier with the light generating unit to be braced against the reflector body. In this process, the locating surfaces of the light generating unit are pressed against the reference surfaces on the reflector body based on the elasticity of the retaining clip. In particular, for this purpose the retaining clip has a steel material, a sheet-metal material, or a plastic material, for example, an elastomer.

The retaining clip can have an elastic spring property so that the bracing of the retaining clip takes place with elastic deformation of the same, wherein a manually operated snap-on part is arranged to further advantage on the retaining clip for introducing the tension. Finally, the retaining clip can preload the carrier in the plane spanned by the at least one locating surface such that the counterstop comes to rest against the stop. To this end, the retaining clip has an engagement point that interlocks with a corresponding mating geometry on the carrier, and when the retaining clip is braced on the carrier, the carrier is displaced together with the light generating unit in the plane spanned by the reference surfaces in such a way that the counterstop on the light generating unit comes to rest in a defined manner against the stop that is mounted or formed on the reflector body.

As a result, the placement and bracing of the retaining clip produces a reproducible, defined position of the light generating unit in every spatial axis. Simply releasing the retaining clip by manually operating the snap-on part makes it possible to release the carrier with the light generating unit without requiring adjustment operations or other settings to be made when the light generating unit with the carrier is to be arranged on the reflector body again.

Further scope of applicability of the present invention will become apparent from the detailed description given hereinafter. However, it should be understood that the detailed description and specific examples, while indicating preferred embodiments of the invention, are given by way of illustration only, since various changes, combinations and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
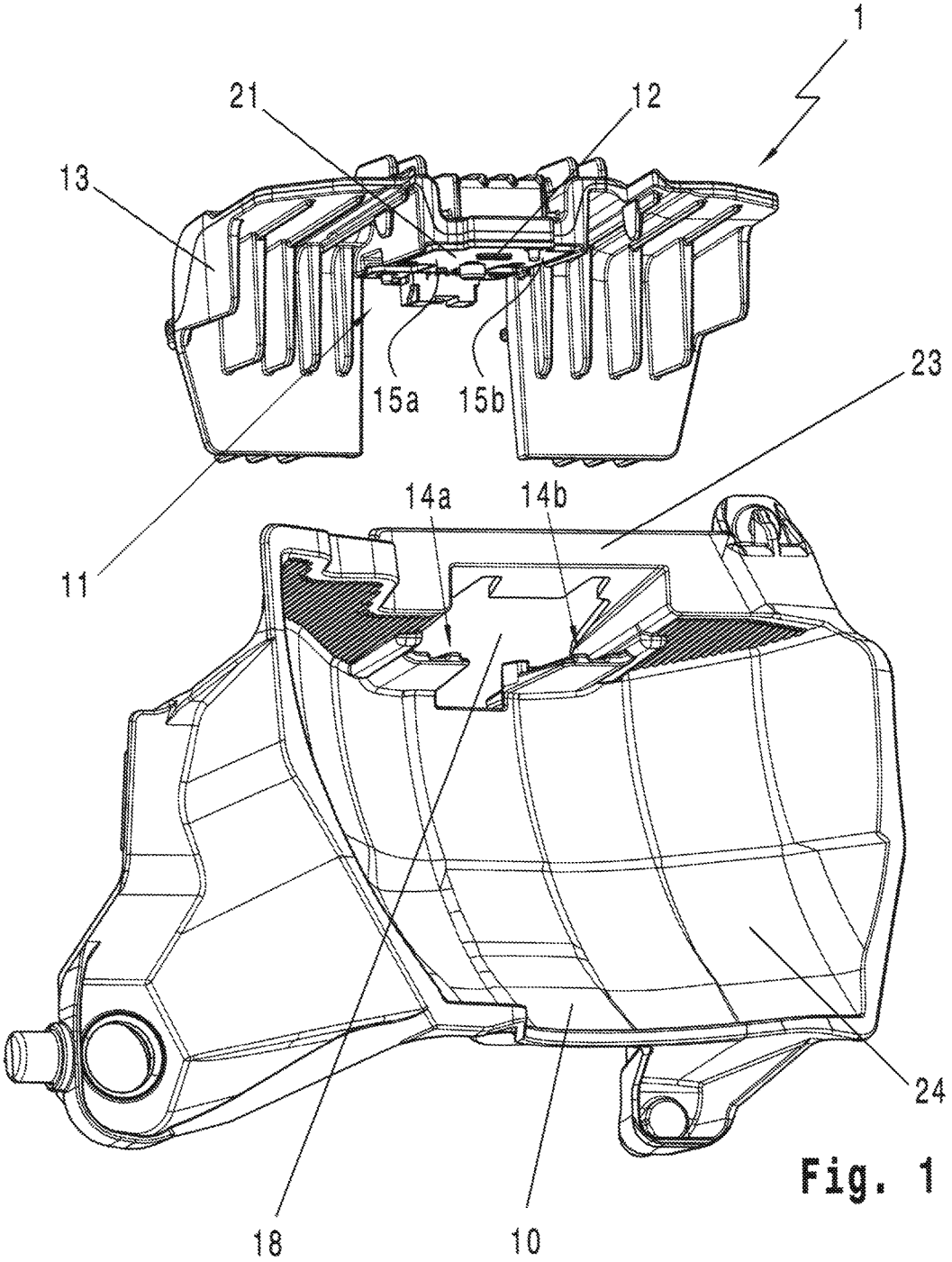
FIG. 1 is a perspective view of a light module for a lighting apparatus of a vehicle having a reflector body and having a carrier on which a light generating unit is arranged, wherein the carrier with the light generating unit has been removed from the reflector body.

FIG. 1 shows, in a perspective view, a light module 1 for a lighting apparatus of a vehicle having a reflector body 10, further including a light generating unit 11 with a light source 12, and a carrier 13 is provided on which the light generating unit 11 is arranged, and the spaced-apart arrangement of the carrier 13 with the light generating unit 11 makes it clear that the light generating unit 11 is replaceably arranged on the light module 1. The reflector body 10 constitutes a sort of base body here and has a receiving section 23, on which the light generating unit 11 with the carrier 13 can be accommodated. The receiving section 23 projects beyond a reflector surface 24 of the reflector body 10, and when the light generating unit 11 is accommodated on the receiving section 23, the light source 12 positions itself in a receiving opening 18 in the receiving section 23. When the light source 12 is activated, light can radiate into the reflector surface 24.

According to an exemplary embodiment of the invention, the reflector body 10 has reference surfaces 14*a* and 14*b* facing toward the light generating unit 11, and the light generating unit 11 has locating surfaces 15*a* and 15*b* facing the reference surfaces 14*a*, 14*b*. If the light generating unit 11 is arranged on the reflector body 10, then the locating surfaces 15*a*, 15*b* come to rest against the reference surfaces 14*a*, 14*b*, so that a precisely positioned arrangement of the light generating unit 11 on the reflector body 10 is created. As a logical consequence, a precise positioning of the light source 12 relative to the reflector surface 24 of the reflector body 10 also occurs.

The carrier 13 can be designed such that it also serves as a heat sink, and the carrier 13 can be braced on the reflector body 10 by an appropriate retainer. The position of the light generating unit 11 relative to the reflector body 10 is not referenced by means of the carrier 13, however, since the carrier provides merely a retaining function for accommodating the light generating unit 11, which retaining function is augmented, at most, by a cooling function. Because the carrier 13 is not part of the positioning arrangement of the light generating unit 11 on the reflector body 10, however, the direct contact of the locating surfaces 15*a*, 15*b* on the reference surfaces 14*a*, 14*b* produces an optimal alignment of the light generating unit 11 on the reflector body 10, without manufacturing and dimensional tolerances of the carrier 13 having an effect on the positioning of the light generating unit 11 on the reflector body 10.

Figure 2:
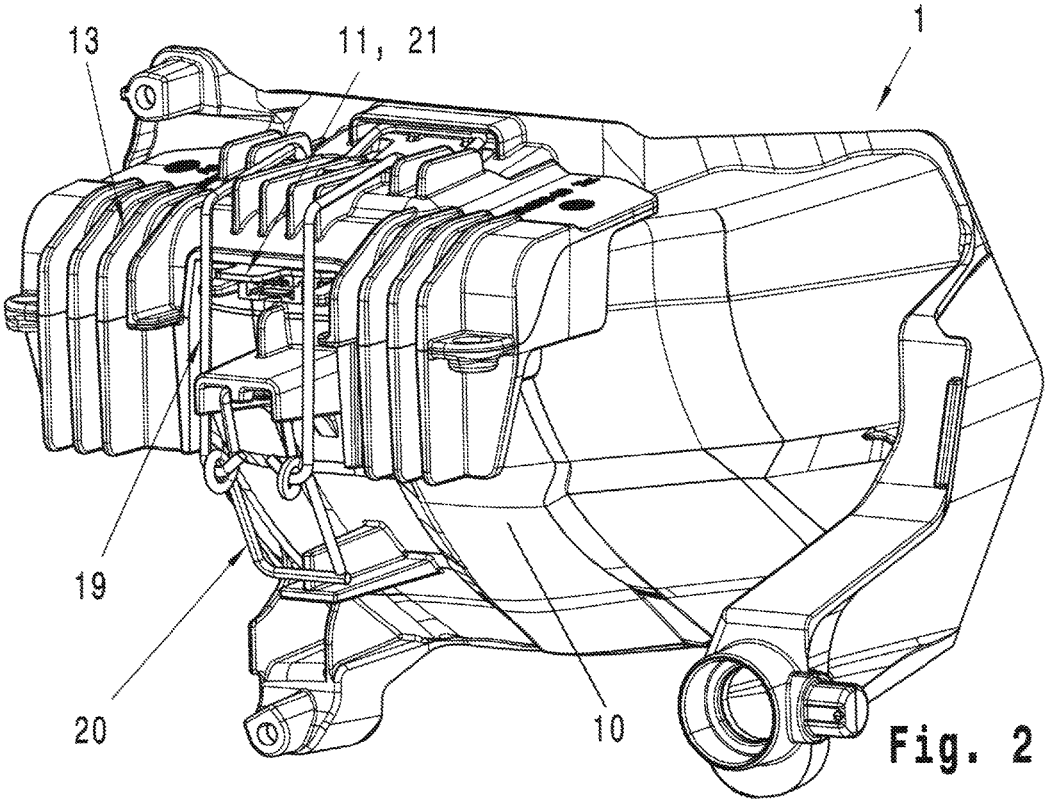
FIG. 2 is the light module from FIG. 1, wherein the carrier with the light generating unit is located on the reflector body.

FIG. 2 shows the arrangement of the carrier 13 with the light generating unit 11 on the reflector body 10. The light generating unit 11 has a printed circuit board 21, on which the light source 12 is arranged (see FIG. 1 in this regard).

A retaining clip 19, which extends around the back of the carrier 13 in a U-shape, serves to attach the carrier 13 to the reflector body 10. A spring preloading can be applied in the retaining clip 19 with a snap-on part 20, and the bracing of the retaining clip 19 with the snap-on part 20 results in a self-locking arrangement of the retaining clip 19 on or between the carrier 13 and the reflector body 10.

Figure 3:
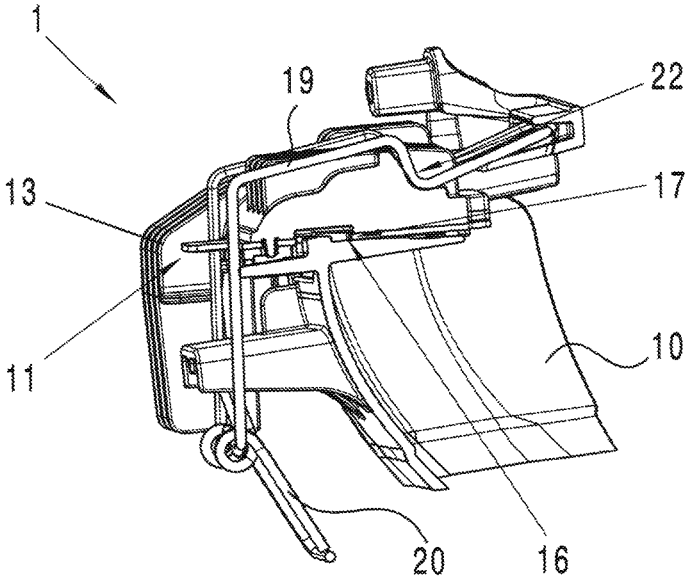
FIG. 3 is a cross-sectional view of the arrangement of the carrier with the light generating unit on the reflector body.

FIG. 3 shows the light module 1 in a cross-sectional view in which a stop 16 on the reflector body 10 can be seen, against which stop a counterstop 17 on the light generating unit 11 is brought to rest. To this end, the carrier 13 is pushed rearward a distance by the retaining clip 19 so that the counterstop 17 rests against the stop 16, for which purpose the retaining clip 19 has an engagement point 22. The light generating unit 11 is displaced essentially in the flat plane of the reference surfaces until the counterstop 17 rests against the stop 16 in a defined manner so that the light generating unit 11 is precisely positioned on the reflector body 10. Moreover, it is especially advantageous here that the stop surfaces 14*a*, 14*b* and 16 are located on the same mold half as the reflector surfaces 24 in FIG. 1. As a result, mold-related dimensional deviations are precluded. Finally, operating the snap-on part 20 braces the retaining clip 19 in such a way that the arrangement shown is ensured for long-term operation of the light module 1.

The invention is not limited in its implementation to the preferred exemplary embodiment provided above. Instead, a number of variants are possible that make use of the described solution even in embodiments that are fundamentally different in nature. All features and/or advantages, including design details, spatial arrangements, and method steps, that derive from the claims, the description, or the drawings, can be essential for the invention individually as well as in a wide variety of combinations.

What is claimed is:

1. A light module for a lighting apparatus of a vehicle, the light module comprising:

a reflector body having at least one reference surface;

a light generating unit having at least one light source and at least one locating surface; and a carrier on which the light generating unit is arranged, the light generating unit being replaceably arranged on the light module, wherein the locating surface is adapted to be brought to rest against the reference surface during insertion of the light generating unit in the light module in order to create a precisely positioned arrangement of the light generating unit on the reflector body, wherein the reflector body has a receiving opening, wherein the carrier covers the light generating unit when the carrier with the light generating unit is arranged on the reflector body, and wherein the light generating unit at least substantially closes the receiving opening in the reflector body.

2. The light module according to claim 1, wherein a first reference surface and a second reference surface are formed on the reflector body, and wherein locating surfaces on the light generating unit are associated with each of the reference surfaces.

3. The light module according to claim 1, wherein the reference surface and a corresponding locating surface are elongated in extent and are spaced laterally apart with respect to the elongated extent and are substantially parallel to one another.

4. The light module according to claim 1, wherein at least a portion of the carrier is a heat sink and/or wherein the light generating unit is retentively arranged on the carrier so that the light generating unit with the carrier is removeable from the light module as a structural unit.

5. The light module according to claim 1, wherein at least one stop is formed on the reflector body, against which stop a counterstop formed on the light generating unit is adapted to be brought to rest, via which the light generating unit is adapted to be aligned in a planar fashion on the reflector body in a plane spanned by the at least one locating surface.

6. The light module according to claim 5, wherein the reference surface and/or the stop at least partially border the receiving opening and/or are arranged adjacent to the receiving opening.

7. The light module according to claim 1, wherein a retaining clip is provided with which the carrier is braced on the reflector body such that at least the locating surface of the light generating unit comes to rest against the reference surface of the reflector body.

8. A light module for a lighting apparatus of a vehicle, the light module comprising:

a reflector body having at least one reference surface;

a light generating unit having at least one light source and at least one locating surface; and a carrier on which the light generating unit is arranged, the light generating unit being replaceably arranged on the light module, wherein the locating surface is adapted to be brought to rest against the reference surface during insertion of the light generating unit in the light module in order to create a precisely positioned arrangement of the light generating unit on the reflector body, wherein a retaining clip is provided with which the carrier is braced on the reflector body such that at least the locating surface of the light generating unit comes to rest against the reference surface of the reflector body, wherein the retaining clip has a manually operated snap-on part with which the retaining clip is elastically braced between the carrier and the reflector body, and wherein the retaining clip includes a steel material, a sheet-metal material, a plastic material, or an elastomer.

9. A light module for a lighting apparatus of a vehicle, the light module comprising:

a reflector body having at least one reference surface;

a light generating unit having at least one light source and at least one locating surface; and a carrier on which the light generating unit is arranged, the light generating unit being replaceably arranged on the light module, wherein the locating surface is adapted to be brought to rest against the reference surface during insertion of the light generating unit in the light module in order to create a precisely positioned arrangement of the light generating unit on the reflector body, wherein a retaining clip is provided with which the carrier is braced on the reflector body such that at least the locating surface of the light generating unit comes to rest against the reference surface of the reflector body, wherein the retaining clip preloads the carrier in a plane spanned by the at least one locating surface such that the counterstop comes to rest against the stop.

* * * * *